United States Patent [19]

Lesueur

[11] Patent Number: 4,565,289

[45] Date of Patent: Jan. 21, 1986

[54] METHOD AND APPARATUS FOR LOADING TUBULAR OBJECTS

[75] Inventor: Pierre Lesueur, Vaux le Penil, France

[73] Assignee: Everitube, Courbevoie, France

[21] Appl. No.: 676,898

[22] Filed: Nov. 30, 1984

[30] Foreign Application Priority Data

Dec. 2, 1983 [FR] France ..... 83 19703

[51] Int. Cl.[4] ..... B65D 85/20

[52] U.S. Cl. ..... 206/443; 53/444; 100/2; 206/83.5; 206/451; 206/516; 248/68.1

[58] Field of Search ..... 100/1, 2, 8; 206/443, 206/83.5, 597, 516, 451; 53/444; 248/68.1

[56] References Cited

U.S. PATENT DOCUMENTS

| | | | |
|---|---|---|---|
| 2,059,390 | 11/1936 | Pagel | 206/443 X |
| 3,283,893 | 11/1966 | Durocher | 206/443 |
| 3,734,281 | 5/1973 | Armstrong | 206/443 X |
| 4,099,617 | 7/1978 | Nist | 206/443 |
| 4,195,732 | 4/1980 | Bell | 206/443 |
| 4,378,923 | 4/1983 | Takei | 206/443 X |
| 4,408,741 | 10/1983 | Mimura | 248/68.1 |

*Primary Examiner*—Billy J. Wilhite

*Attorney, Agent, or Firm*—Sughrue, Mion, Zinn, Macpeak and Seas

[57] ABSTRACT

A bundle of tubular pipes 1 is assembled by laying a first bed of p pipes on lateral support beams 2, banding it to the beams, placing key blocks 4 between at least the two outermost pipes on each side of the bed, laying a second bed of p pipes on top the first in vertical columns, clamping the ends of the two outermost pipes on each side of the second bed together, laying an upper bed of p−1 pipes on top the second bed in a staggered manner, and strapping the bundle near its ends.

10 Claims, 3 Drawing Figures

FIG. 1
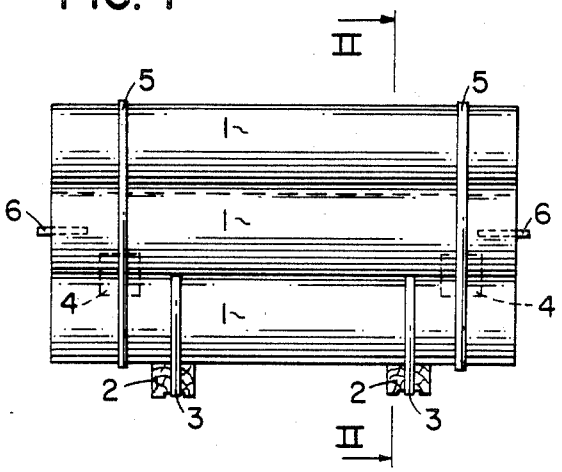
FIG. 2
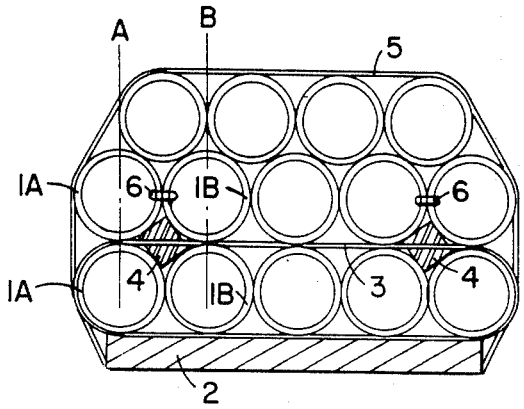
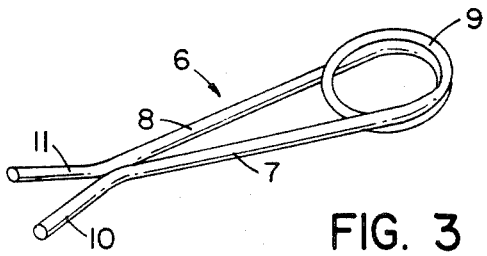
FIG. 3

METHOD AND APPARATUS FOR LOADING TUBULAR OBJECTS

BACKGROUND OF THE INVENTION

This invention relates to a method and apparatus for loading tubular objects, such as pipes, to facilitate their transport, stocking and distribution.

It is known to stack pipes on top of one another such that their axes are all situated in vertical planes with the lower bed of pipes resting on beams or other supports. The whole stack is rendered rigid by interposing cotter keys or spacers between successive beds in order to prevent the pipes which are in contact from rolling on each other, and by banding the supprots and the pipes with straps.

This type of stacking is not always satisfactory, however, since it is necessary to wedge protective boards between the banding straps and the pipes. These boards are arranged horizontally on top of the last bed of pipes, and laterally along each end stack of pipes, and they are generally made of wood. This material is sensitive to hygrometric variations and it often happens that, following a drying and therefore a shrinkage of the wood, the straps become distended. The load is then likely to be subjected to dangerous movement during transport which can damage the pipes.

In addition, although an assembly of pipes laid one on top of the other is in principle stable since they are in contact with each other along upper and lower generatrices, the slightest horizontal pressure, such as that due to the unevenness of the ground, causes the pipes to fall during unstacking after the straps are cut. Such a fall is dangerous for the personnel assigned to the handling operation and causes breakage.

SUMMARY OF THE INVENTION

The present invention overcomes these disadvantages. Its method is characterized by composing the first bed of pipes, connecting the bed to the support beams by a band, positioning the spacers, placing a second bed of pipes on top the first bed, connecting the two end pipes on each side of the second bed to each other, and placing the last bed of the load such that the pipes thereof rest in a staggered arrangement on the underlying bed. The load thus produced is far more cohesive than that normally obtained.

The apparatus of the invention is constituted by means for connecting at least a first bed of pipes with the support beams, key blocks or spacers for preventing the pipes from rolling on one another, and means for connecting the two end pipes on each side of the intermediate beds to one another.

BRIEF DESCRIPTION OF THE DRAWINGS

FIG. 1 is a profile view of a pipe stack produced in accordance with the invention;

FIG. 2 is a cross-sectional view of the stack along line II—II of FIG. 1; and FIG. 3 is a large scale perspective view of a connecting device in accordance with the invention.

DETAILED DESCRIPTION OF THE PREFERRED EMBODIMENT

In accordance with FIGS. 1 and 2 the loading of an assembly of pipes 1 begins by placing a first bed of pipes on beams or similar supports 2 with which, and at right angles to which, the bed assembly is connected by means of bands or straps 3. This lower bed is therefore rendered stable since no pipe can escape therefrom and, before proceeding to place a second bed, key blocks 4 of a known type are placed, preferably between the ends of pipes 1 and the vertical plane passing through each support, such that they rest on each pair of adjacent end pipes. The key blocks are for example of a square shape, such that they will also be in contact with the generatrices of each pair of end pipes of the next upper bed, which is laid immediately after the blocks 4 are placed. When the second bed is laid, the two end pipes on each side are connected to each other by an appropriate connecting means. Since the pipes form vertical stacks A, B, . . . , pipes 1A and 1B of two adjacent lateral stacks in the second bed cannot move towards the outside of the load since pipe 1A is connected to pipe 1B, which is in turn held by key block 4 placed between pipes 1A and 1B of the underlying bed which is already banded.

It is therefore possible to use the upper bed thus laid as a support for the last bed of pipes, which is placed in a staggered arrangement such that the total height of the stack is less than in a strictly vertical stacking of three superposed beds. The loading is completed by a final banding of the assembly of pipes, for example at the positions of the blocks 4, using straps 5. If the blocks 4 are made of a deformable material, the banding with straps 5 causes them to be compressed and guarantees contact between the blocks and the four pipes which surround them.

As indicated above, the two pipes in the two end stacks of a same bed are connected to each other by means which are easy to place without causing damage. For example, a flexible clamp 6 as shown in FIG. 3 constitutes an assembly means which is easy to introduce at the level of the contact generatrix of the two pipes with one another. This clamp, which may be composed of metal wire, has two feet 7, 8 which are connected to one another by a spring loop 9 which maintains them pressed against one another. The feet preferably have outwardly flaring ends 10, 11 to facilitate the introduction of claim 6 between two contiguous pipes. In addition, the spring loop preferably extends beyond the stack of pipes, thus facilitating both the placing and the removal of the clamp.

The example described relates to a load of three beds of pipes which is the most advantageous, but the same method applies when the load contains any number n of beds, in which n−1 are vertically stacked with the upper bed n being placed in a staggered arrangement on the pipes of the n−1 bed. In this case, there are two possibilities:

(a) either the first bed of pipes is connected with support beams, key blocks are arranged on each bed up to and including the n−2 bed, and the two end pipes on each side of each bed, from the second bed up to that of bed n−1, are clamped together; or (b) the first n−1 beds are stacked at the factory inside a gauge or guide; the key blocks and clamps are arranged as above to avoid movement of the load during the removal of strap 5, but strap 3 which connects with the support beams can encircle more than one bed of pipes.

Using the apparatus combination of straps 3 between the first bed of pipes 1 and the support beams 2, the key blocks 4 and clamps 6, the load thus produced has exceptional stability as verified by transport without using exterior bands 5.

In addition, not using numerous lateral and upper wooden wedges interposed between the pipes and the straps avoids the stretching of the bands, in addition to gaining space.

Finally, the reduction by one unit of the number of pipes in the upper bed and its staggered arrangement enables the load to be fitted more easily into the gauges typically used in rail transport, and it has even been noted, for an identical load surface area, that there is a considerable increase in the number of pipes transported.

What is claimed is:

1. A method for assembling a bundle of tubular pipes, comprising the steps of:

(a) laying a first bed of a number (p) of pipes (1) laterally across spaced support beams (2), (b) banding (3) the first bed to the beams, (c) placing key blocks (4) between at least two outermost pipes on each side of and atop the first bed, (d) laying at least one intermediate bed of a number (p) of pipes on top of the first bed in vertical columns, (e) clamping together adjacent ends of two outermost pipes on each side of the intermediate bed flanking the key blocks, and (f) laying an upper bed of a number (p−1) of pipes on top of an uppermost intermediate bed in a staggered arrangement with each upper bed pipe resting between two columns of underlying pipes.

2. A method according to claim 1, further comprising securing the beds together with bundle encircling straps (5).

3. A method according to claim 2, wherein the key blocks are resiliently deformable, and are compressed by the encircling straps.

4. A method according to claim 2, wherein there are a number (n) of beds of pipes, and key blocks are placed on the first number (n−2) of beds.

5. A method according to claim 4, wherein the key blocks are placed between each end of a pipe bed and a nearest support beam.

6. A method according to claim 5, wherein the straps overlie the key blocks.

7. An apparatus for assembling a bundle of tubular pipes, comprising in combination:

(a) at least two horizontally spaced beams (2) for laterally supporting successive beds of pipes in vertically stacked columns, (b) band means (3) for individually securing a first, lowermost bed of pipes to the beams, (c) a plurality of key blocks (4) for individual placement between at least two outermost pipes on each side of and atop a bed to prevent pipes in a next higher bed from rolling, and (d) a plurality of means (6) for individually clamping together adjacent ends of two outermost pipes on each side of each intermediate bed flanking the key blocks.

8. Apparatus according to claim 7, wherein the key blocks are substantially square, are resiliently deformable, and are dimensioned to fit closely within a fluted space defined between four adjacent pipes arranged in two rows and columns.

9. Apparatus according to claim 7, wherein each clamping means comprises a spring clip (6) having two elongate feet (7, 8) joined at their one ends by a spring loop (9) and having outwardly flaring toes (10, 11) at their other ends.

10. Apparatus according to claim 8, wherein each clamping means comprises a spring clip (6) having two elongate feet (7, 8) joined at their one ends by a spring loop (9) and having outwardly flaring toes (10, 11) at their other ends.

* * * * *